United States Patent [19]

Clark

[11] Patent Number: 4,709,916

[45] Date of Patent: Dec. 1, 1987

[54] BOWLERS GRIP EXERCISER

[76] Inventor: Dean Clark, Box 1821, Riverton, Wyo. 82501

[21] Appl. No.: 837,901

[22] Filed: Mar. 10, 1986

[51] Int. Cl.[4] ..... A63B 5/00; A63B 21/02; A61H 1/02

[52] U.S. Cl. ..... 272/67; 272/140; 128/26

[58] Field of Search ..... 272/67, 68, 142, 140; 128/26; 84/465, 467–469

[56] References Cited

U.S. PATENT DOCUMENTS

| | | | |
|---|---|---|---|
| 1,301,560 | 4/1919 | Hill | 272/67 |
| 1,472,906 | 4/1922 | Gorrell | 272/67 |
| 1,796,216 | 5/1930 | Petterson | 272/68 |
| 2,634,976 | 4/1950 | Mock | 272/68 |
| 3,298,689 | 4/1963 | Santora | 272/67 |
| 3,447,415 | 2/1967 | Kime | 272/67 |
| 3,606,316 | 5/1969 | Krewer | 272/67 |
| 3,738,651 | 6/1973 | Norman | 272/67 |
| 3,756,594 | 9/1973 | Goodwin | 272/68 |
| 3,871,646 | 3/1975 | Slack | 272/68 |
| 4,343,465 | 8/1982 | Allen | 272/67 |

FOREIGN PATENT DOCUMENTS

| | | | |
|---|---|---|---|
| 848319 | 8/1970 | Canada | 272/67 |

*Primary Examiner*—Richard J. Apley
*Assistant Examiner*—S. R. Crow
*Attorney, Agent, or Firm*—Lewis E. Massie

[57] ABSTRACT

A finger, hand and wrist exercising device, for bowlers, having finger grips simulating the arrangement of the finger holes on a bowling ball. The grips are slidably disposed on the arcuate surface of the exerciser and are spring loaded against compression between the fingers and thumb. The exerciser has a rotatable hand grip knob on the bottom surface. The hand grip knob is loaded in torsion against rotation of the exerciser. The arcuate radius on the exerciser surface being the same as that of a bowling ball.

2 Claims, 4 Drawing Figures

BOWLERS GRIP EXERCISER

BACKGROUND OF THE INVENTION (1) Field of the Invention

The present invention relates to a device for exercising the muscles of the fingers, hand and wrist as they relate to the controlled delivery of a bowling ball.

(2) Description of the Prior Art

Heretofore such devices were of the compressible ball type and the types as shown in the U.S. Pat. Nos. 1,472,906, Gorrell; 1,796,216, Petterson; 2,634,976, Mock; 3,606,316, Krewer; 3,738,651, Norman.

None of the above listed patents specifically address the requirements of the bowler.

SUMMARY OF THE INVENTION

Accordingly an object of the present invention is to provide a finger, hand and wrist exercising device for developing the muscles and coordination utilized in delivering a bowling ball.

Another object is to provide means for readily adjusting the loading means for opposing the movement of each finger separately and the rotational movement of the hand and wrist.

Other and further objects will be shown by the illustrative embodiment described herein or in the appended claims.

DESCRIPTION OF THE PREFERRED EMBODIMENT

Figure 1:
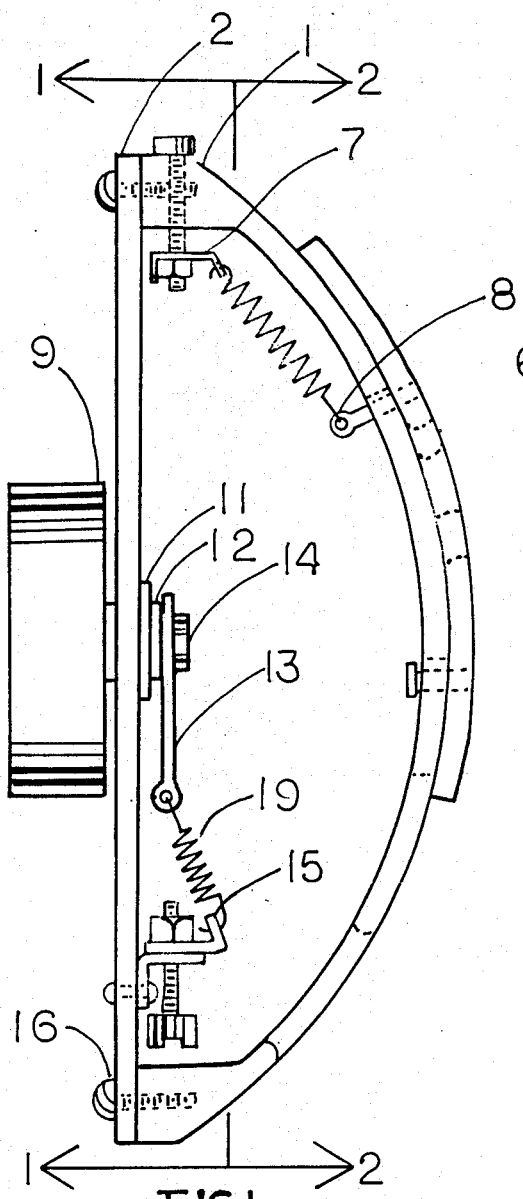
FIG. 1 is a left side view of the exercising device.
Figure 2:
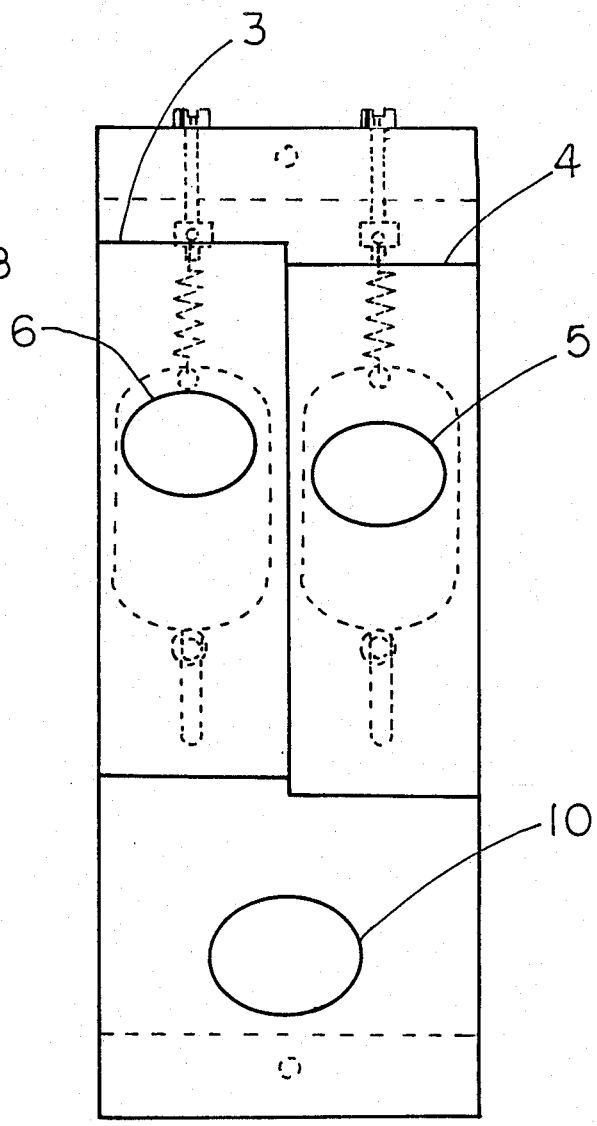
FIG. 2 is a top view of the exercising device.
Figure 3:
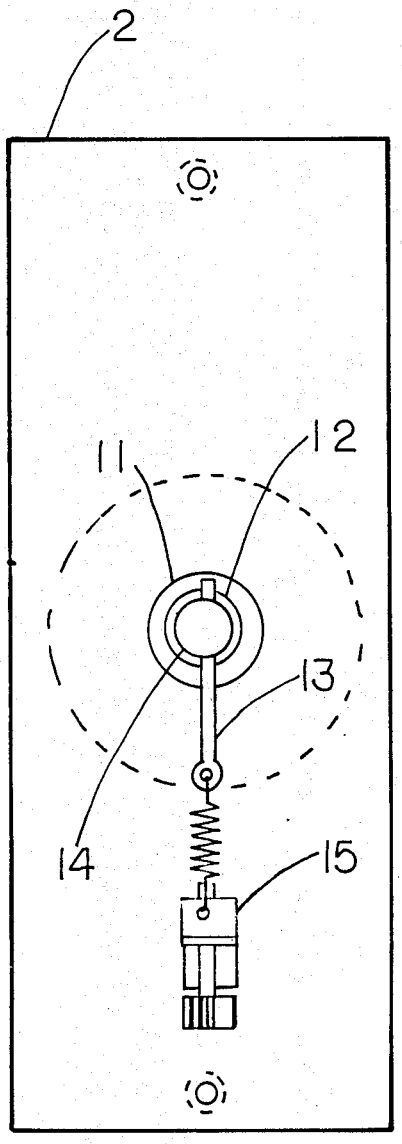
FIG. 3 is a sectional view taken alone the line 1—1 of the device.
Figure 4:
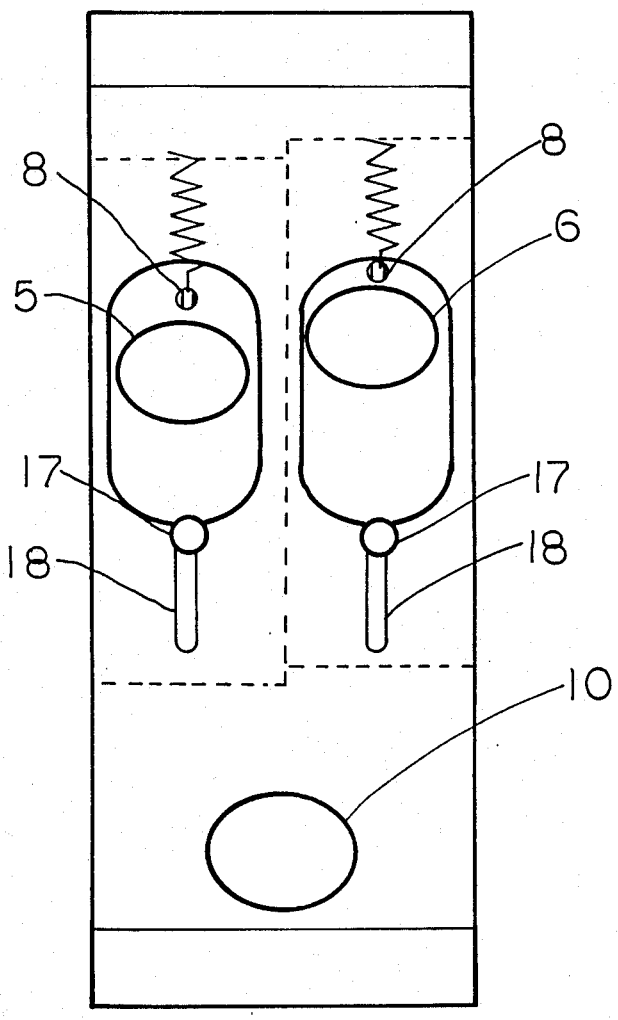
FIG. 4 is a sectional view taken along the line 2—2 of the device.

Referring to the drawings, there is shown an arcuate casing 1 of plastic or metal having the same radius of a bowling ball. Conforming arcuate members 3, and 4, with finger grips 5, and 6, slidably disposed on the outer surface of the casing 1. The finger grip members 5, and 6, are spring loaded in the extended position by adjustable springs extending from the supports 8, on the grip members to adjusting screws 7 on the casing 1. The grip members are restrained to movement in the extending and compressed positions by guide pins 17 slidably engaging slots 18 in the casing 1. A bottom plate 2 is fastened to the casing 1, by screws 16. A rotatable hand grip knob mounted in the center of the plate 2 having a shaft 14 extending through the plate 2 with washers 11, and 12, on the inside of the plate 2. Spring support member 13, fastened to the shaft 14, securing the knob assembly. Tension spring 19, extending from spring support member 13, to adjusting screw assembly 15, loads the hand grip knob in torsion with respect to the casing 1, and plate 2, assembly.

In operation the exercising device is placed in the palm of one hand with the fingers gripping the knob 9. The second and third fingers of the other hand engaging the finger grips 5, and 6, and the thumb engaging the grip 10. Repeated compression of the fingers to the thumb will strengthen the finger muscles and provide a degree of deterity to the fingers. Simultaneously, rotating the casing assembly around the torsion loaded knob exercises the hand and wrist.

What is claimed is:

1. In a device for exercising a bowler's fingers, hand and wrist wherein the improvement comprises:

a. an arcuate chord shaped casing having the same radius as a bowling ball;

b. two slidable arcuate members with finger grips spring tensioned in the finger extended position;

c. longitudinal slots in the arcuate casing for guiding the movement of the finger grips;

d. a thumb grip on the arcuate casing;

e. the position of the finger and thumb grips simulating the arrangement of the finger holes on a bowling ball;

f. means for tensioning the movement of the finger grip members towards the thumb grip;

g. a rotatable hand grip knob on the bottom of the exerciser; and, h. said rotatable hand grip knob spring tensioned in torsion with respect to the casing.

2. The exercising device as described in claim 1 wherein the improvement comprises:

a. means for adjusting the tension springs restraining the movement of the finger grips from the extended position; and, b. means for adjusting the tension springs restraining rotation of the hand grip knob.

* * * * *